US010490177B2

(12) United States Patent
Manzo et al.

(10) Patent No.: US 10,490,177 B2
(45) Date of Patent: Nov. 26, 2019

(54) MUSICAL INSTRUMENT ELECTRONIC INTERFACE

(71) Applicant: Worcester Polytechnic Institute, Worcester, MA (US)

(72) Inventors: Vincent J. Manzo, Lyndhurst, NJ (US); Ryan P. McKenna, Nantucket, MA (US)

(73) Assignee: Worcester Polytechnic Institute, Worcester, MA (US)

( * ) Notice: Subject to any disclaimer, the term of this patent is extended or adjusted under 35 U.S.C. 154(b) by 0 days.

(21) Appl. No.: 16/116,176

(22) Filed: Aug. 29, 2018

(65) Prior Publication Data

US 2019/0066647 A1 Feb. 28, 2019

Related U.S. Application Data

(60) Provisional application No. 62/551,382, filed on Aug. 29, 2017.

(51) Int. Cl.

| | |
|---|---|
| ***G10H 3/00*** | (2006.01) |
| ***G10H 3/18*** | (2006.01) |
| ***G10H 1/46*** | (2006.01) |

(52) U.S. Cl.

CPC ..... *G10H 3/182* (2013.01); *G10H 1/46* (2013.01); *G10H 3/181* (2013.01); *G10H 3/185* (2013.01); *G10H 3/186* (2013.01); *G10H 2220/461* (2013.01)

(58) Field of Classification Search

CPC ..... G06F 3/162; H04R 25/407; H04R 1/1033; G10H 3/186; G10H 1/0058; G10H 3/18; G10H 3/181; G10H 3/06

See application file for complete search history.

(56) References Cited

U.S. PATENT DOCUMENTS

| | | | | |
|---|---|---|---|---|
| 6,353,169 | B1 * | 3/2002 | Juszkiewicz | G10H 1/0058 369/4 |
| 2004/0103776 | A1 * | 6/2004 | Juszkiewicz | G10H 1/0058 84/742 |
| 2004/0168566 | A1 * | 9/2004 | Juszkiewicz | G10H 1/0058 84/723 |
| 2004/0261607 | A1 * | 12/2004 | Juszkiewicz | G10H 1/0058 84/645 |

(Continued)

*Primary Examiner* — Marlon T Fletcher

(74) *Attorney, Agent, or Firm* — Armis IP Law, LLC

(57) ABSTRACT

A switching device receives an output cable from a guitar. The output cable has a plurality of conductors corresponding to each of the pickups on the guitar, typically 2 or 3. A passthrough signal based on manually switched pickup selection corresponds to a main guitar output. A pickup buffer circuit on the guitar isolates the signal conductors from the selected passthrough signal, and also switches the pickup buffer circuit on and off to allow for backwards compatibility. A multi-conductor cable and jack simultaneously transmits the plurality of signals to the switching device. The switching device receives the multi-conductor cable. A combination circuit in the switching device combines the signals from the pickups and also delivers the individual pickup signals to a respective output jack. Each output jack simultaneously delivers the respective pickup or combined signal to a mixer, amplifier or other signal processing device for recording and/or further processing.

16 Claims, 8 Drawing Sheets

(56) References Cited

U.S. PATENT DOCUMENTS

| | | | | |
|---|---|---|---|---|
| 2005/0027888 | A1* | 2/2005 | Juszkiewicz | G10H 1/0058 709/250 |
| 2006/0236850 | A1* | 10/2006 | Shaffer | G10H 1/0016 84/724 |
| 2007/0003073 | A1* | 1/2007 | Iriarte | G10H 1/0083 381/77 |
| 2007/0234880 | A1* | 10/2007 | Adams | G10H 1/0066 84/601 |
| 2010/0269670 | A1* | 10/2010 | O'Connor | G10H 1/0091 84/626 |
| 2012/0294457 | A1* | 11/2012 | Chapman | G10H 1/0091 381/98 |
| 2014/0033900 | A1* | 2/2014 | Chapman | G10H 1/0083 84/609 |
| 2014/0096667 | A1* | 4/2014 | Chapman | G10H 1/0058 84/609 |
| 2015/0059562 | A1* | 3/2015 | Burmas | G10H 1/44 84/742 |
| 2015/0199949 | A1* | 7/2015 | Fishman | G10H 3/143 84/726 |
| 2015/0262566 | A1* | 9/2015 | Ceccolini | G10H 1/348 84/746 |
| 2015/0332660 | A1* | 11/2015 | Adams | G10H 1/0066 84/645 |
| 2016/0336037 | A1* | 11/2016 | Terai | G10H 1/0033 |
| 2019/0066647 | A1* | 2/2019 | Manzo | G10H 3/182 |

* cited by examiner

MUSICAL INSTRUMENT ELECTRONIC INTERFACE

RELATED APPLICATIONS

This patent application claims the benefit under 35 U.S.C. § 119(e) of U.S. Provisional Patent App. No. 62/551,382, filed Aug. 29, 2017, entitled "MUSICAL INSTRUMENT ELECTRONIC INTERFACE," incorporated herein by reference in entirety.

BACKGROUND

Conventional electric guitars interface with a single amplifier, due to the size and expense of an amplifier. Multiple pickups on the guitar are adapted to receive a signal from the vibration of guitar strings. Due to the different location of the pickups, each pickup may interpret a slightly different sound from the same string. A typical guitar has neck, bridge, and middle pickups, referring to the location of the pickup on the instrument. Conventional guitars employ a selector switch or the like on the guitar to direct signals from a particular pickup to the amplifier or receiver connected to the guitar.

Modern electronics allow recordation and mixing of musical audio signals, and widely available applications (apps) allow even a novice user to perform sophisticated manipulations of multiple recorded tracks. These modern apps allow users to perform sound editing on a standard computing device (e.g. laptop or smartphone) to a level which was once only available to professionals having expensive hardware.

Conventional musical instruments, however, typically deliver a single (mono) sound signal. Performed music requires multiple microphones to capture stereo left and right signals. Some instruments, such as electric guitars, directly deliver an electronic medium, however it is still a mono signal.

SUMMARY

A switching device receives an output cable from a musical instrument such as a guitar. The output cable has a plurality of conductors corresponding to each of the pickups on the guitar, typically 2 or 3. A passthrough signal based on a manually switched pickup selection corresponds to a main guitar output in conventional approaches. A pickup buffer circuit on the guitar isolates the signal conductors from the selected passthrough signal, and the pickup buffer circuit switches on and off to allow for backwards compatibility. A multi-conductor cable and jack simultaneously transmits the plurality of signals to the switching device. The switching device receives the multi-conductor cable in place of a conventional breakout box. A combination circuit in the switching device combines the signals from the pickups and also delivers the individual pickup signals to a respective output jack. Each output jack simultaneously delivers the respective pickup or combined signal to a mixer, amplifier or other signal processing device for recording and/or further processing. A power supply delivers DC power for the switching device, and also delivers 9 v to the pickup buffer circuit on the guitar through one of the conductors in the cable.

Configurations herein are based, in part, on the observation that conventional electric guitars employ only a single mono plug for connection to downstream devices such as amplifiers, mixers and recorders. Guitars often have multiple "pickups," which are sensory devices between the strings and guitar body that sense the vibration in the guitar strings and convert the vibratory movement into electronic signals. In a typical guitar, a bridge pickup and neck pickup are adjacent the guitar bridge and neck, respectively. The signals delivered from the pickups may exhibit a slightly different musical characteristic. The output signal from the guitar may be from one of the pickups, or from a combination of the pickups. Unfortunately, conventional guitars suffer from the shortcoming that only one signal may be delivered at a time to the downstream devices. Accordingly, configurations herein substantially overcome the shortcomings of single signals by providing a switching device similar to a breakout box, switching circuit and cable for providing simultaneous output signals from multiple pickups. Simultaneous output is selectable from either pickup, a middle pickup as available on some guitars, or a combination of the pickups. All signals may be simultaneously transmitted to the downstream devices, such as a multi-channel mixer that can now simultaneously record individual tracks corresponding to the signals from each pickup or combination thereof. Individual signals may be selected by a foot-activatable mute switch on the device.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Depicted below is an example configuration of the switching device in the context of a guitar based rendering for simultaneously delivering musical signals (signals) from each of the neck and bridge pickups, along with a combined signal and a "through" or switched signal controlled by a switch on the guitar. A typical guitar has a body mounted pickup selector switch for selecting either of the pickups as the output. In conventional approaches, this through signal is the sole mono signal emanated from the guitar, as is typical with conventional musical instruments.

Figure 1:
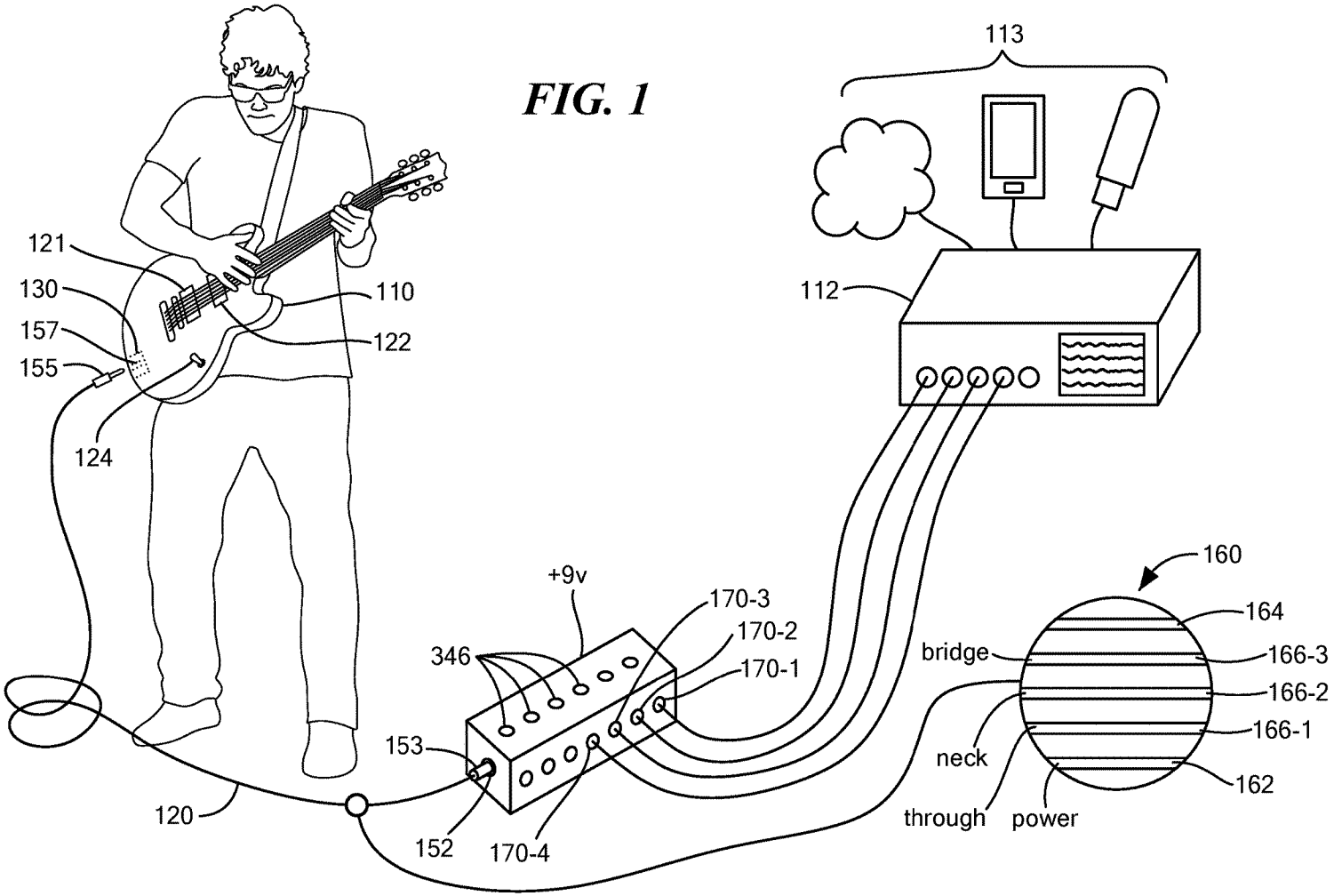
FIG. 1 is a context view of the switching device in use with a guitar and mixing appliance.

FIG. 1 is a context view of the switching device 150 in use with a guitar 110 and mixing appliance 112. The guitar 110 includes a bridge pickup 121, neck pickup 122, and a pickup selector switch 124. The pickup selector switch 124, in conventional guitars, select the single output to be based on the bridge pickup, neck pickup, or a combined neck and bridge signal, but only a single mono signal is output based on the pickup selector switch 124. In configurations herein, a pickup buffer circuit 130 allows simultaneous output from the bridge and neck pickups, in addition to the through signal based on the pickup selector switch 124. Music signals, as denoted herein, are any analog or digital signal adapted to render an audio impulse on a speaker or similar device.

In a musical performing and recording environment 100, a switching device 150 for music signals includes an input jack 152 adapted to receive a cable 120 from a musical instrument. The cable 120 has conductors 160 corresponding to the input jack 152 and including power 162, ground 164, and a plurality of signal conductors 166-1 . . . 166-3 (166 generally). A plurality of output jacks 170-1 . . . 170-4 (170 generally) are each configured to simultaneously transmit an output signal. Each output signal is based on one or more of the signal conductors 166. The switching device 150 aggregates some of the signals on the signal conductors 166 to generate combined signals, hence the number of output jacks 170 may be greater than the number of signal conductors 166 on the input.

In the example of FIG. 1, the output jacks further include a through jack 170-1 for passing a musical signal on a signal conductor responsive to the pickup selector switch 124 on the musical instrument (the through signal), and jacks 170-2, 170-3 having the respective bridge and neck pickup signals. An aggregate jack 170-4 passes an aggregate signal based on a combination of the neck and bridge (166-2, 166-3) signal conductors. The device 150 includes a buffer, discussed further below, connected between the aggregate jack and the neck and bridge signal conductors to isolate the aggregate output and avoid signal degradation or compromise that would otherwise occur from multiple "pickoff" or taps onto the signal conductors 166. Mute switches 346, discussed further below, turn individual outputs on and off.

Figure 2:
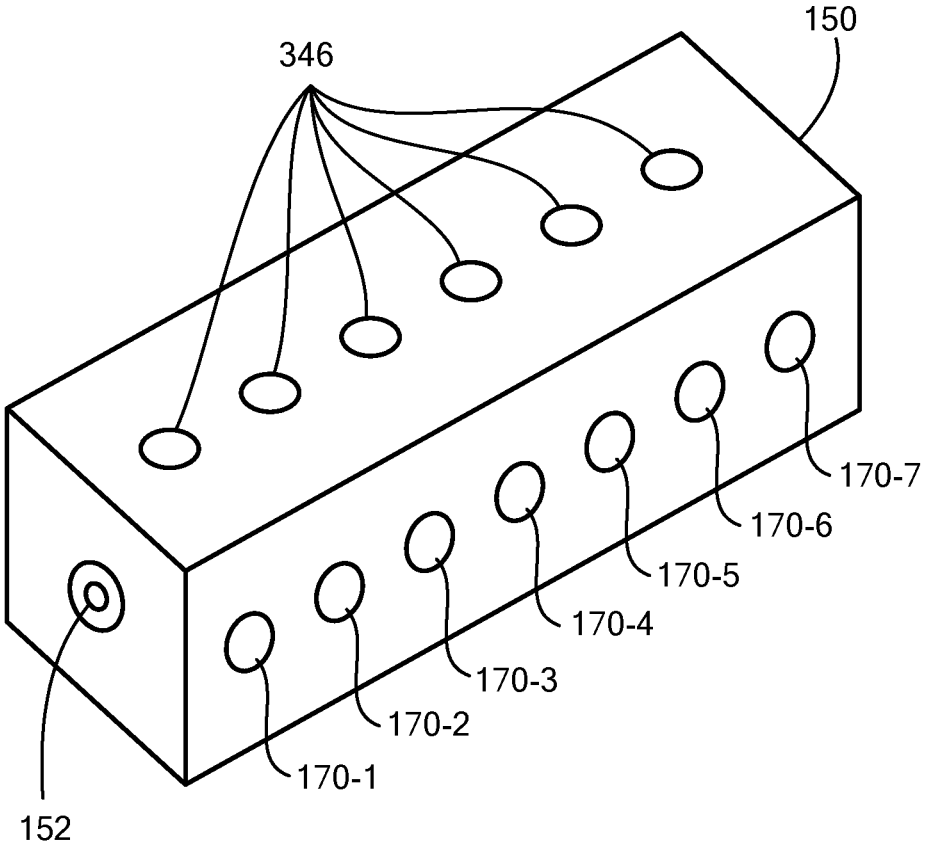
FIG. 2 is a perspective view of the switching device of FIG. 1.

FIG. 2 is a perspective view of the switching device of FIG. 1. Referring to FIGS. 1 and 2, the novel switching device 150 has an appearance and placement similar to a conventional breakout box, which typically occupies the floor area in front of the musician and has foot-actuated switches in a button form. FIG. 2 is an example of a device 150 configuration operable with a 3 pickup guitar, having neck, bridge and middle pickups. In such a configuration, the input jack 152 supports power 162, ground 164, and signal conductors 166 corresponding to each of the bridge, neck and middle pickups, in addition to the through conductor 166-1. A corresponding plug 153 engages the jack, 152, discussed further below. Aggregated output signals include bridge and middle, middle and neck, and neck and bridge, in addition to the dedicated individual pickups and the through signal. Both two pickup and 3 pickup configurations are discussed further below, however the disclosed signal aggregation could be implemented for any suitable number of pickups or similar signal origination on other musical instruments.

Figure 3:
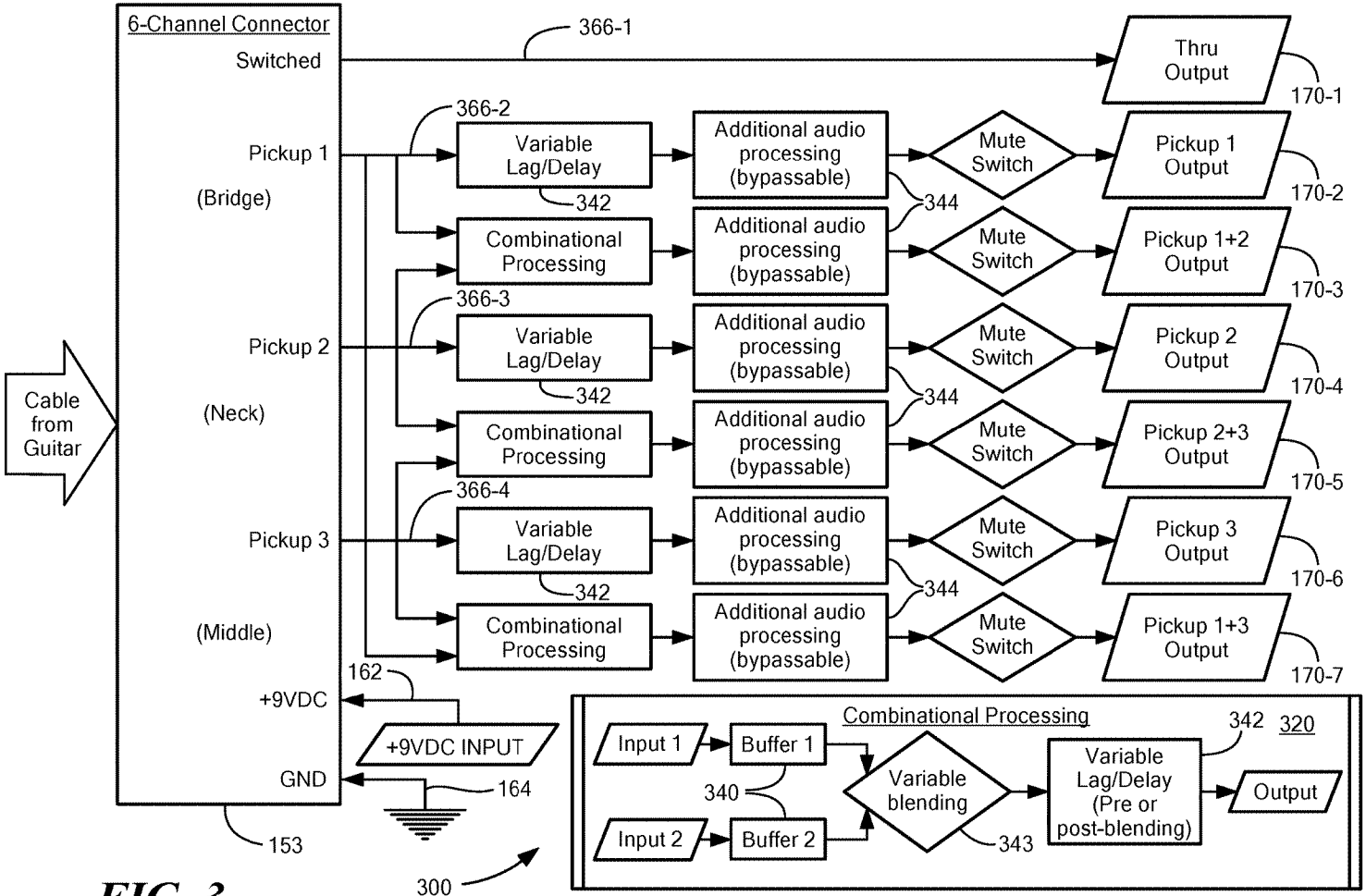
FIG. 3 is an architecture diagram of the switching device of FIG. 2.

FIG. 3 is an architecture diagram of the switching device of FIG. 2. Referring to FIGS. 1-3, the architecture 300 is implemented in the switching device 150 for connecting and aggregating the signals on the input conductors 166 to the output jacks 170. FIGS. 2 and 3 depict an implementation with a 3 pickup guitar, while FIG. 1 shows a 2 pickup guitar. In each case, handling of the additional middle pickup with either of the neck or bridge is similar to the 2 pickup processing of the neck and bridge. The cable 120 provides a 6 channel (6 conductor) connection. Any suitable connection, such as an XLR plug, a ¼ in. microphone plug discussed below, or other engaging connector may be used. Each conductor 166 provides a corresponding input signal 366. The through conductor 166-1 provides through signal 366-1. A bridge pickup conductor 166-2 provides a bridge pickup signal 366-2. A neck pickup conductor 166-3 carries neck pickup signal 366-3, and a middle pickup conductor provides a middle pickup signal 366-4 (the 2 pickup configuration of FIG. 1 has no middle pickup). Single pickup signals are passed through to the corresponding output. This includes the through signal 366-1 that provides through output 170-1. Bridge pickup signal 366-2 provides bridge output (pickup 1) 170-2. Neck signal 366-3 provides neck output (pickup 2) 170-4, and middle pickup signal provides middle output (pickup 3) 170-6.

Aggregate signals that combine multiple pickups are combined according to combinational processing 320 (similar handling occurs for each of the 3 aggregate signals). A buffer 340 connects each of a plurality of the signal conductors 166 to an aggregate jack for forming a combined signal. The buffer 340 isolates the "pickoff" or tap of the input so that the additional combined output does not interfere with the dedicated pickup signal. A buffer 340 as employed herein refers to a circuit function interposed to interface between two subcircuits. The buffer 340 is an interposed element which keeps the source from being affected by the load attributes, but delivers the same or nearly the same voltage and current it sees at its own input. In the architecture 300 of FIG. 3, a buffer 340 is connected between each aggregate jack 170-3, 170-5, 170-7 and the plurality of signal conductors 166 upon which the aggregate signal is based. A combiner 343 defines an analog mixing of the constituent signals, however other circuitry, such as digital combination and variable contribution may be performed. For example, a rheostat may be included to vary the relative signal contribution other than a 50-50 equal contribution.

For any of the individual or aggregate signals delivered on output jacks 170-2 . . . 170-7, lag or delay circuitry 342 may be provided. Other audio processing 344 may also be implemented in the device 150 for varied effects before emanating on an output jack 170. A push button mute switch 346 enables and disables the respective signal output, such as by a foot press of the musician. A mute switch 346 switch connects to each of the output jacks for selective activation of a musical signal carried via the output jacks. Each of the output jacks 170 is adapted to receive a connection to a subsequent musical input device 112, typically via a standard ¼ TRS plug, although any suitable output plug may be employed, and individual output signals may be suppressed using the mute switch 346. The subsequent musical input device 112 may include one or more of a mixer, amplifier, speaker, sound processor or recorder, such that the subsequent musical input device is adapted for simultaneous receipt of musical signals carried on a plurality of the output jacks. Once recorded, any suitable electronic medium 113 may receive the subsequent recordings or individual tracks.

In addition to the signal conductors 166 providing the pickup signals, a 9 v DC power signal 162 and ground 164 are provided for powering the pickup buffer circuit 130 on the guitar. The same 9V power supply may be invoked for powering an active pickup, pre-amplifier, or any electronics onboard the guitar that require power through a connection to the power conductor 162 for powering the active pickup.

The signal conductors 166 include the through conductor 166-1 which carries a signal responsive to the pickup selector switch 124 on the musical instrument. The pickup selector switch allows legacy operation using a conventional mono plug, and may also be used to augment the other signal conductors 166, as all are received by the device 150. The through signal, however, is passed from the guitar 110 without aggregation with signals on other conductors 166. The pickup selector switch 124, rather, is used to determine the pickup(s) carried by the through conductor 166-1. The pickup buffer circuit 130 includes relays activated by the 9V power conductor. When no 9V power is seen on the cable 120, the guitar defaults to a mono mode where only the signal based on the pickup selector switch is output, discussed further now with respect to FIGS. 4 and 5.

Figure 4:
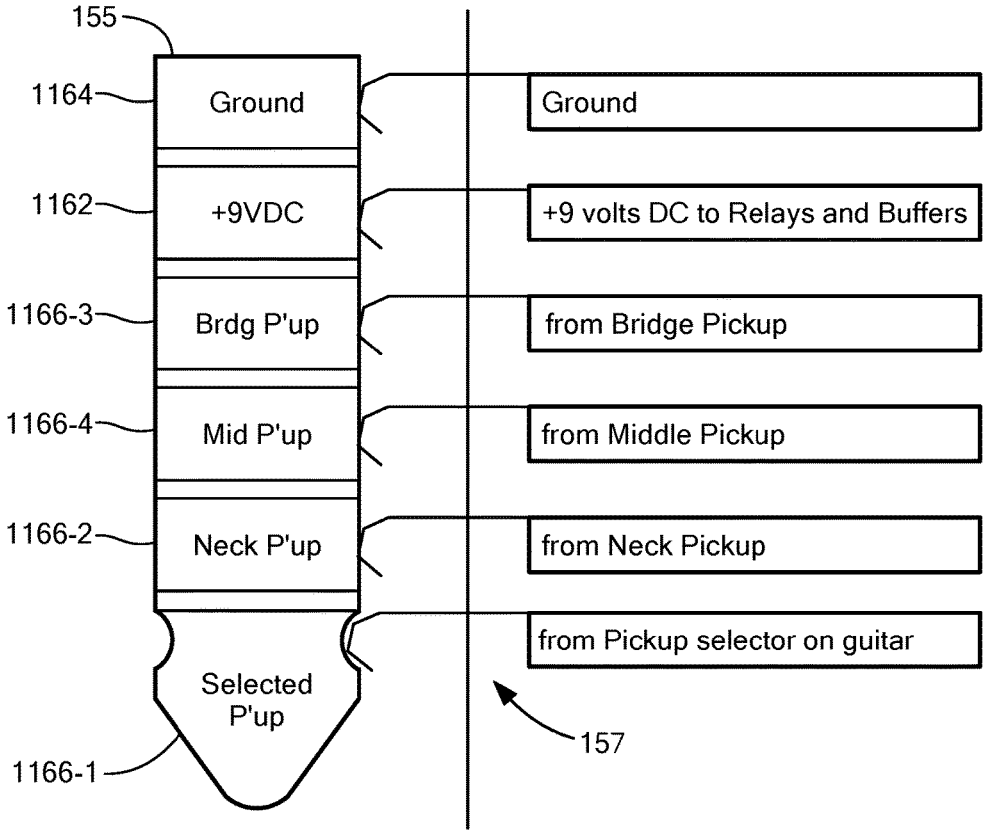
FIG. 4 is a multi-conductor plug and jack operable for use with the switching device of FIG. 3.

FIG. 4 is a multi-conductor plug and jack operable for use with the switching device of FIG. 3. In an example arrangement as shown, the signal conductors 166 connect to the musical instrument via a plug 155 having a respective axially arranged concentric conductor for each of the ground 1164, power 1162 and signal conductors 1166-1 . . . 1166-3 (1166 generally), such that the plug 155 corresponds to an industry standard mono plug size of ¼ in. TRS, taking the form of a T4RS for 4 conductors in addition to the tip and ground. The plug 155 has similar male contact arrangements on both ends of the cable 120. The jack 157 has the corresponding conductor arrangement, as well as the jack 152 on the device 150 for receiving the plug 153. While the T4RS plug disclosed facilitates backwards compatibility with ¼ in. phone plugs, any suitable form of an engaging plug may be employed. The pickup buffer circuit 130 therefore connects to the plug receptacle jack 157 adapted to receive the plug and engages the plug receptacle contacts for each of the plurality of concentric conductors, such that each of the cable conductors corresponds to one of the concentric conductors. The pickup buffer circuit 130 therefore outputs the pickup signals on the corresponding signal conductors 166 for receipt by the switching device 150.

Figure 5:
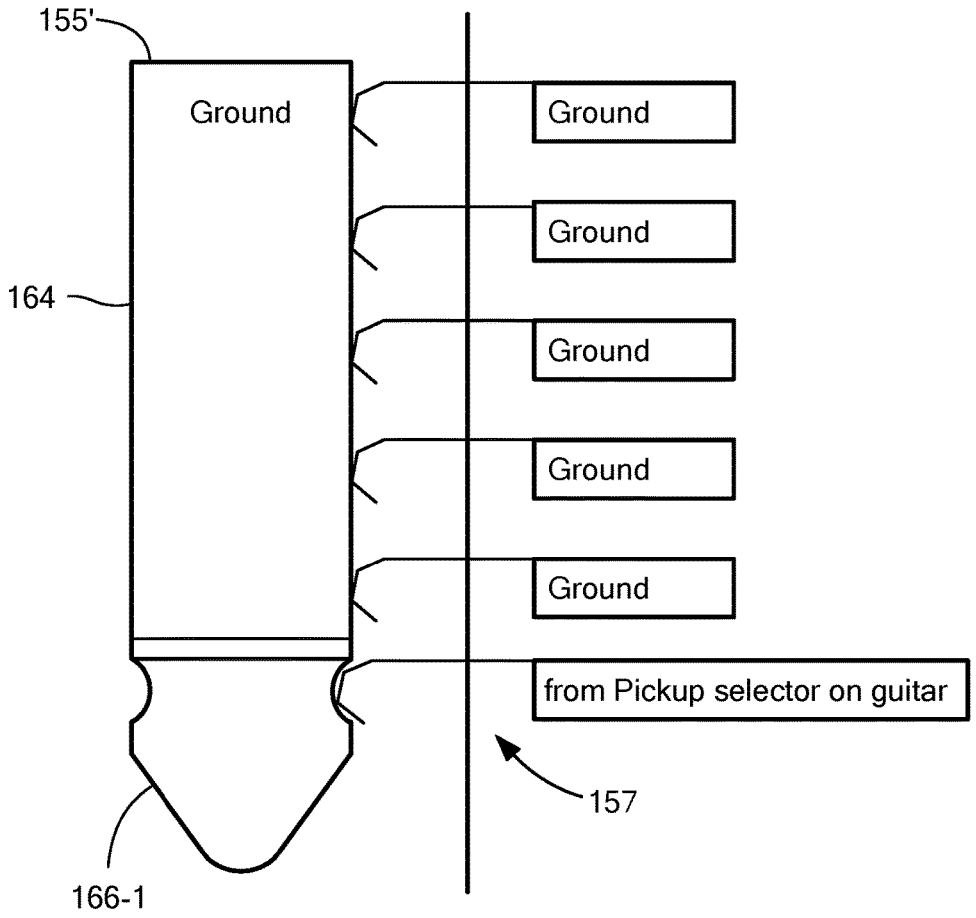
FIG. 5 shows a backwards compatible jack in the arrangement of FIG. 4.

FIG. 5 shows a backwards compatible jack in the arrangement of FIG. 4. Continuing with the plug receptacle 157 of the pickup buffer circuit 130, when a standard ¼ in. tsp plug 155' is inserted, no power source is available, causing the pickup buffer circuit 130 to enter a legacy mode where the signal conductors 166 are seen as grounds except for the tip 166-1, resulting in a standard mono signal on the conductor 166-1 corresponding to the through (pickup selector 124 switched) and ground.

Figure 6:
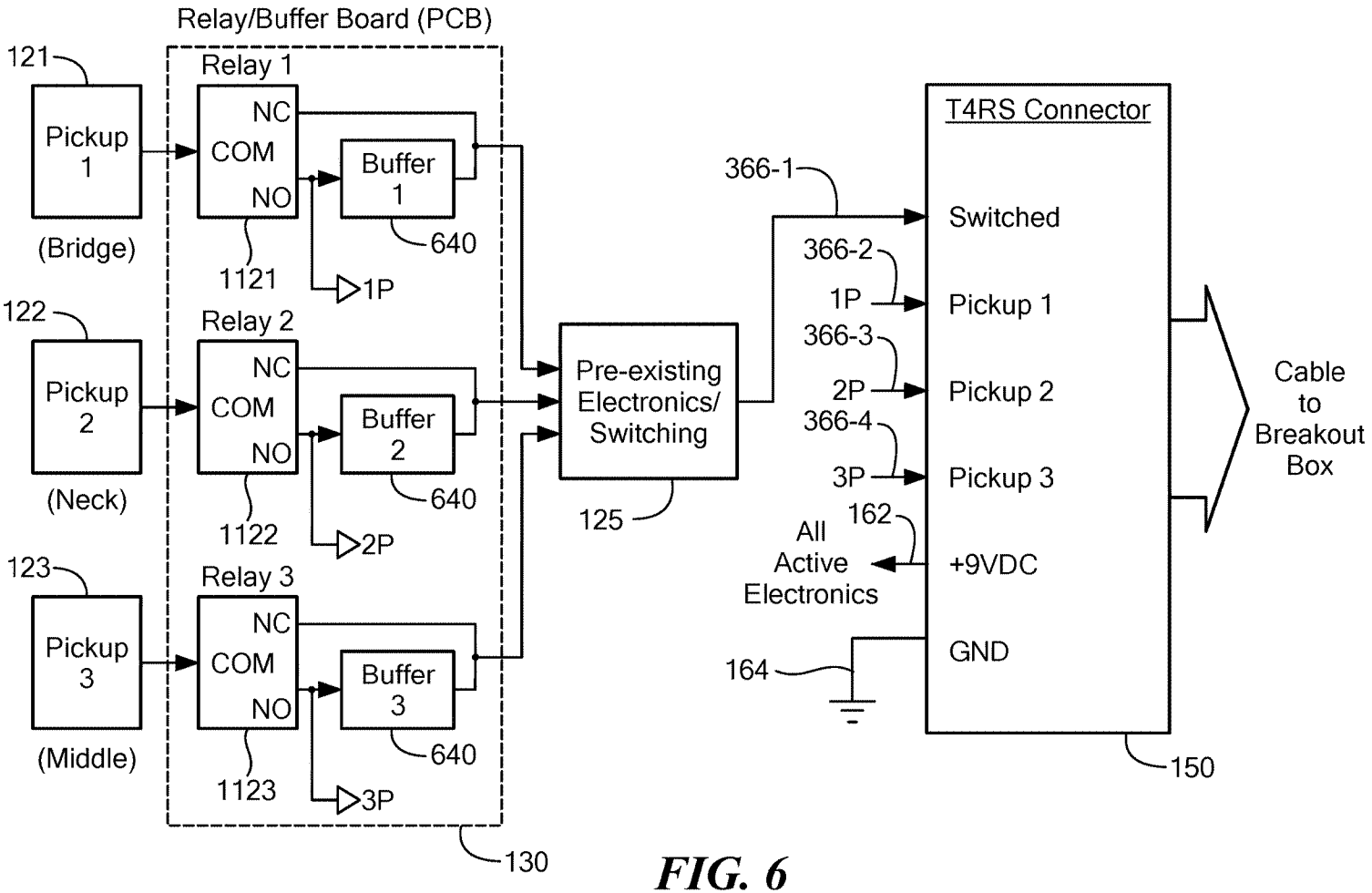
FIG. 6 is a block diagram of the pickup buffer circuit on the guitar.

FIG. 6 is a block diagram of the pickup buffer circuit 130 on the guitar 110. On the guitar 110, each of the signal conductors 166 connects to at least one pickup 121, 122 of the guitar 110 via a relay switched connection. The guitar 110 has a bridge pickup 121, neck pickup 122 and may also include a middle pickup. The pickup buffer circuit 130 is implemented between the pickups and the existing pickup selector switch 124 and any other effects, such as attenuation, delay, damping, etc, present on the guitar 110.

The block diagram in FIG. 6 includes a 3 pickup implementation, including pickup 1 (bridge) 121, pickup 2 (neck) 122, and pickup 3 (middle) 123. Each pickup connects to a respective relay 1121, 1122 and 1123 having a NO (normally open) and NC (normally closed) output. The power conductor 162 connects to the relays for activating the relays to switch the bridge, neck and middle pickups through the buffer circuit to a respective signal conductor in the cable. When energized by the power conductor 162, the NO branch closes to receive the pickup signal and direct it to the corresponding buffer. Each of the bridge and neck pickups is connected to a relay switched buffer circuit 640. The power conductor 162 is connected to the relays for activating the relays to switch the bridge and neck pickups through the buffer circuit to a respective signal conductor in the cable 120. The buffer circuits 640 simultaneously pass a signal from the bridge, neck and middle (if present) pickups to the native electronics 125 on the guitar, in which the native electronics connect to a signal conductor to the through jack. A tap 1P, 2P, 3P also receives the pickup signal and directs it to the corresponding conductor on the switching device 150. The buffer 640 isolates the pickup signal to allow the preexisting guitar electronics 125 including the pickup selector 124 to also receive an unadulterated signal. Each of the signal conductors 166 is therefore responsive to a buffer circuit 640 the musical instrument, such that the buffer circuit 640 is configured to isolate the signal conductors from a native output signal of the musical instrument. Without the buffer, the "split" or tapped signal might be affected, however the buffer 640 ensures that substantially the same input is seen from the pickup. In this scenario, the native output signal passes through the pickup selector switch 124 such that the pickup selector switch is operable to provide a musical signal to the through jack 170-1, based on one or more of the pickups, simultaneously with musical signals on the other signal conductors 166.

In the backwards compatibility case where a standard mono plug is inserted, the relays default to the NC position and simply pass the pickup signal through to the preexisting electronics 125, as the buffer 640 is inactive. This allows the guitar 110 to perform as if no pickup buffer circuit 130 were present.

Figure 7:
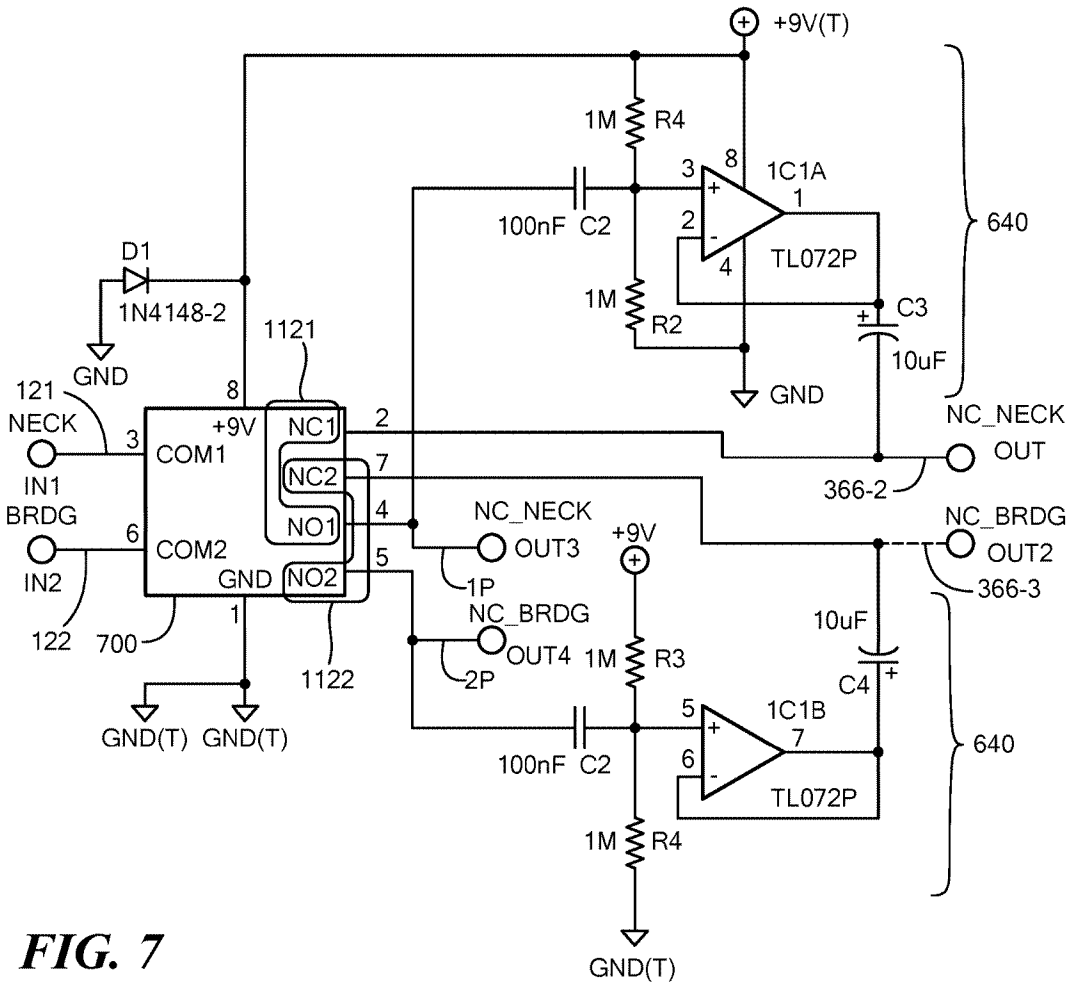
FIG. 7 is a schematic diagram of a pickup buffer circuit for a 2 pickup guitar.

FIG. 7 is a schematic diagram of a pickup buffer circuit for a 2 pickup guitar. Referring to FIGS. 6 and 7, no handling of pickup 3 (middle) is needed in FIG. 7. A buffer circuit 640 is responsive to the relay 1121, 1122 when the relay switched by the power conductor from the cable, such that the relay has a normally open position for powering the buffer circuit and a normally closed position for permitting a single output signal corresponding to the pickup selector switch. The implemented relay 700 is a DPDT (double pole, double throw) leaving the switching operation of relays 1121, 1122 encapsulated together Multiple SPST relays could have been employed. In both FIGS. 6 and 7, the buffer circuit 640 connects each of the pickups 121, 122 to a signal conductor for isolating the signal conductor from the native output signal, in which the native output signal corresponds to the through jack 170-1 and each of the buffer circuits connects to a corresponding pickup for providing a musical signal on a corresponding signal conductor 166.

Figure 8:
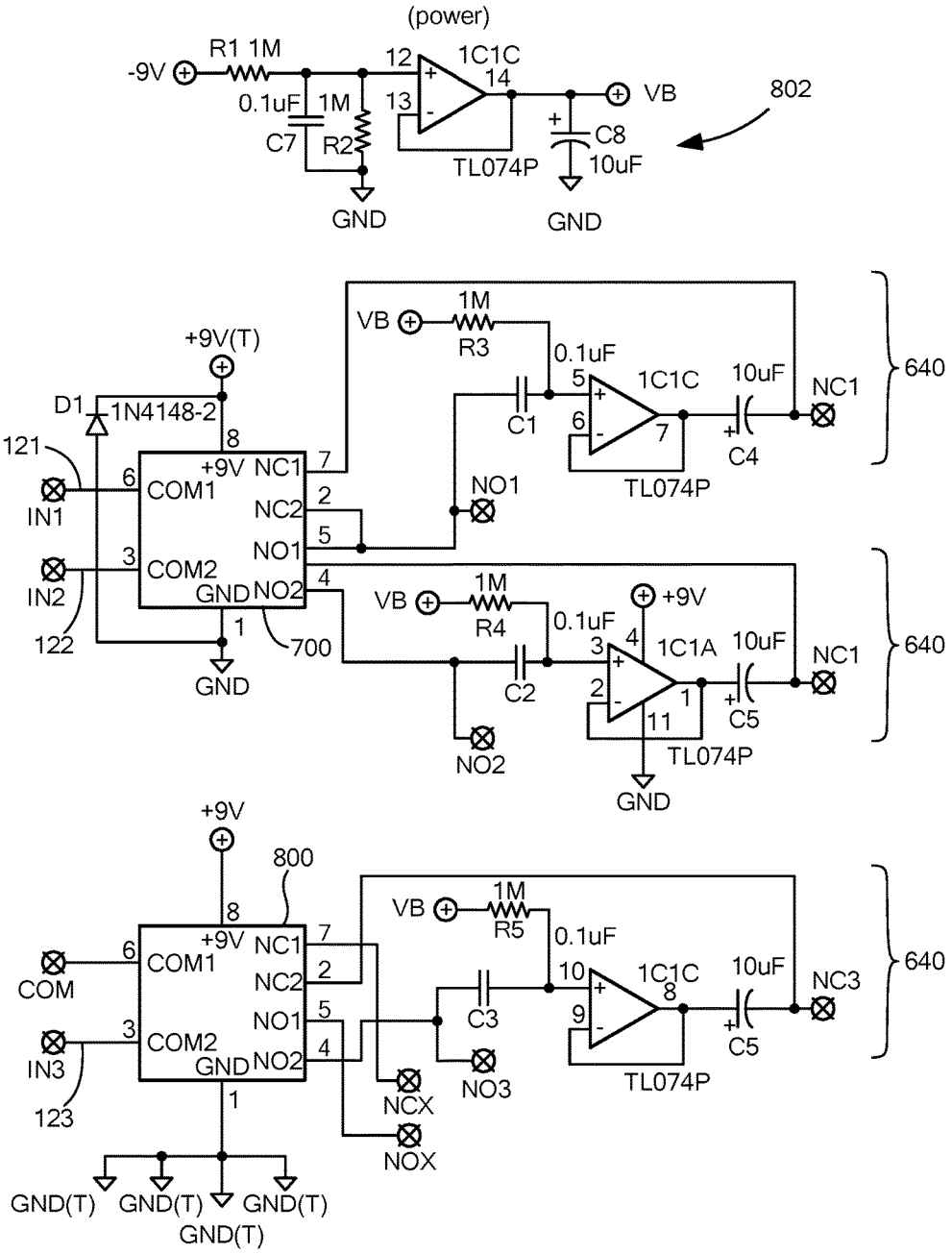
FIG. 8 is a schematic diagram of a pickup buffer circuit for a 3 pickup guitar.

FIG. 8 is a schematic diagram of a pickup buffer circuit for a 3 pickup guitar. In FIG. 8, DPDT relays are also employed, however only one pole of the relay serving pickup 3 (middle) is needed. The remaining pole is available for expansion. The implementation of FIG. 8 encapsulates the pickup buffer circuit 124 for a 3 element guitar 110 connected to the switching device 150. The switching device includes an input jack adapted to receive a cable from an output of the guitar, the input jack 152 having conductors for power 162, ground 164, and a plurality of signals 166. Each signal of the plurality of signals is based on at least one pickup on the guitar, and others are a combination of 2 or more pickups. A plurality of output jacks include a primary pass through responsive to the pickup selector switch 124 on the guitar, and selectable outputs are responsive to the pickups on the guitar. A plurality of mute switches 346 activates each of the selectable outputs. The selectable outputs include an output from each pickup on the guitar, and an aggregate output from a combination of pickups on the guitar. A buffer 640 is connected between the aggregate output and an input from which the aggregate output is combined. Each of the output jacks 170 is adapted to simultaneously provide a corresponding output signal based on the plurality of signals received via the input jack, allowing simultaneous rendering and/or recording of each individual pickup as well as the combined aggregate signals from the neck/bridge, neck/middle and middle/bridge.

Other musical instruments having capability for multiple outputs may also be configured as disclosed, such as a bass or keyboard, for example. The cable 120 may be terminated by other suitable connectors for providing the needed conductors, depending on the number of pickups captured. Similarly, the switching device 150 may employ alternate signal combinations in addition to those disclosed. Also, the disclosed T4S connector plug may be employed in alternate configurations for providing a plurality of conductors in a form factor similar to a ¼ phone plug.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. A switching device for music signals, comprising:

an input jack adapted to receive a cable from a musical instrument, the input jack having conductors corresponding to the cable and including power, ground, and a plurality of signal conductors, each of the signal conductors responsive to a buffer circuit on the musical instrument, the buffer circuit configured to isolate the signal conductors from a native output signal of the musical instrument;

a plurality of output jacks, each output jack configured to simultaneously transmit an output signal, each output signal based on one or more of the signal conductors;

the output jacks further including:

a through jack for passing a musical signal on a signal conductor responsive to a switch on the musical instrument; and an aggregate jack for passing an aggregate signal, the aggregate signal based on a plurality of the signal conductors; and a buffer connected between the aggregate jack and at least two of the plurality of signal conductors, the signal conductors connect to the musical instrument via a plug having a respective axially arranged concentric conductor for each of the ground, power and signal conductors, the plug corresponding to an industry standard mono plug size.

2. The device of claim 1 wherein a buffer connects each of a plurality of the signal conductors to an aggregate jack for forming a combined signal.

3. The device of claim 1 wherein a buffer is connected between each aggregate jack and the plurality of signal conductors upon which the aggregate signal is based.

4. The device of claim 1 wherein each of the signal conductors connects to at least one pickup of a guitar via a relay switched connection.

5. The device of claim 1 wherein one of the signal conductors is responsive to a pickup selector switch on the musical instrument.

6. The device of claim 1 wherein the native output signal passes through a pickup selector switch, the pickup selector switch operable to provide a musical signal to the through jack, based on one or more of the pickups, simultaneously with musical signals on the other signal conductors.

7. The device of claim 1 wherein the buffer circuit connects each of the pickups to a signal conductor for isolating the signal conductor from the native output signal, the native output signal corresponding to the through jack and each of the buffer circuits connects to a corresponding pickup for providing a musical signal on a corresponding signal conductor.

8. The device of claim 6 wherein the buffer circuit is responsive to a relay, the relay switched by the power conductor from the cable, the relay having a normally open position for powering the buffer circuit and a normally closed position for permitting an output signal corresponding to the pickup selector switch.

9. The device of claim 1 wherein the musical instrument is a guitar having a bridge pickup, neck pickup and middle pickup, the power conductor connected to the relays for activating the relays to switch the bridge, neck and middle pickups through the buffer circuit to a respective signal conductor in the cable.

10. The device of claim 1 further comprising a switch connected to each of the output jacks for selective activation of a musical signal carried via the output jacks, each of the output jacks adapted to receive a connection to a subsequent musical input device.

11. The device of claim 10 wherein the subsequent musical input device includes one or more of a mixer, amplifier, speaker, sound processor or recorder, the subsequent musical input device adapted for simultaneous receipt of a musical signals carried on a plurality of the output jacks.

12. The device of claim 1 wherein the buffer circuit connects to a plug receptacle adapted to receive the plug, the plug receptacle having contacts for each of a plurality of concentric conductors, each of cable conductors corresponding to one of the concentric conductors.

13. The device of claim 1 further comprising an active pickup and a connection to the power conductor for powering the active pickup.

14. The device of claim 1 wherein the concentric power conductor is operable for activating relays for providing the signal outputs, the absence of the concentric power conductor resulting in a legacy mode for providing a standard mono signal to the plug.

15. A switching device for music signals, comprising:

an input jack adapted to receive a cable from a musical instrument, the input jack having conductors corresponding to the cable and including power, ground, and a plurality of signal conductors, each of the signal conductors responsive to a buffer circuit on the musical instrument, the buffer circuit configured to isolate the signal conductor from a native output signal of the musical instrument;

a plurality of output jacks, each output jack configured to simultaneously transmit an output signal, each output signal based on one or more of the signal conductors;

the output jacks further including:

a through jack for passing a musical signal on a signal conductor responsive to a switch on the musical instrument; and an aggregate jack for passing an aggregate signal, the aggregate signal based on a plurality of the signal conductors; and a buffer connected between the aggregate jack and at least two of the plurality of signal conductors, the musical instrument being a guitar having a at least a bridge pickup and a neck pickup, each of the bridge and neck pickups connected to a relay for switching the buffer circuit, the power conductor connected to the relays for activating the relays to switch the bridge and neck pickups through the buffer circuit to a respective signal conductor in the cable;

the buffer circuits configured to simultaneously pass a signal from the bridge and neck pickups to native electronics on the guitar, the native electronics connected to a signal conductor connected to the through jack.

16. A mixing device for an electric guitar, comprising:

an input jack adapted to receive a cable from an output of the guitar, the input jack having conductors for power, ground, and a plurality of signals, each signal of the plurality of signals based on at least one pickup on the guitar;

a plurality of output jacks, the output jacks including a primary pass through responsive to a pickup selector on the guitar, and selectable outputs responsive to the pickups on the guitar;

a plurality of switches for activating each of the selectable outputs, the selectable outputs including:

an output from each pickup on the guitar; and an aggregate output from a combination of pickups on the guitar; and a buffer between the aggregate output and an input from which the aggregate output is combined, each of the inputs adapted to connect to a signal conductor responsive to a buffer circuit on the guitar, the buffer circuit configured to isolate the signal conductors from a native output signal of the guitar, the signal conductor adapted to connect to the guitar via a plug having a respective axially arranged concentric conductor for each of the ground, power and signal conductors, the plug corresponding to an industry stand mono plug size, each of the output jacks adapted to simultaneously provide a corresponding output signal based on the plurality of signals received via the input jack.

* * * * *